US007037119B2

(12) United States Patent
Collins

(10) Patent No.: US 7,037,119 B2
(45) Date of Patent: May 2, 2006

(54) COIL SPRING EXTENSION MECHANISM FOR A PC CARD

(75) Inventor: Paul S. Collins, Temecula, CA (US)

(73) Assignee: Intel Corporation, Santa Clara, CA (US)

( * ) Notice: Subject to any disclaimer, the term of this patent is extended or adjusted under 35 U.S.C. 154(b) by 277 days.

(21) Appl. No.: 10/039,015

(22) Filed: Jan. 2, 2002

(65) Prior Publication Data

US 2003/0124888 A1 Jul. 3, 2003

(51) Int. Cl.
*H01R 13/44* (2006.01)

(52) U.S. Cl. ..... 439/131

(58) Field of Classification Search ..... 439/131, 439/946, 152–160, 26; 361/737, 736, 752; 343/702, 901, 895; 455/121, 900; 709/250; 235/497

See application file for complete search history.

(56) References Cited

U.S. PATENT DOCUMENTS 5,536,180 A * 7/1996 Ishida et al. ..... 439/159
6,375,479 B1 * 4/2002 Johnson et al. ..... 439/131

* cited by examiner

*Primary Examiner*—Alexander Gilman

(74) *Attorney, Agent, or Firm*—Trop, Pruner & Hu, P.C.

(57) ABSTRACT

The extent of outward movement of a spring biased antenna in a personal computer card may be increased by offsetting the coil spring with respect to the track that guides the inward and outward movement of the antenna. By allowing additional extension, better radio reception or transmission may be achieved.

8 Claims, 7 Drawing Sheets

COIL SPRING EXTENSION MECHANISM FOR A PC CARD

BACKGROUND

This invention relates generally to personal computer cards and particularly to such cards which include an antenna for implementing a wireless capability.

Personal computers and particularly laptop or mobile computers may receive a card which enables the computer to receive wireless communications. One such card is a Type II PC card. The card slides into a slot in the personal computer and provides the functionality to implement wireless communications, for example between wirelessly connected personal computers. The cards may include a retractable antenna that may spring out to facilitate radio frequency communications.

Because of the compact size of the card, it is desirable to have an antenna that extends outwardly from the card (which may be largely contained within the personal computer). The further the extension of the antenna, generally the better its reception and transmission.

However existing personal computer cards have extendable antennas that have a relatively limited range of extension. Thus, it would be desirable to provide a personal computer card with an antenna that extends further outwardly of the body of the card.

DETAILED DESCRIPTION

Figure 1:
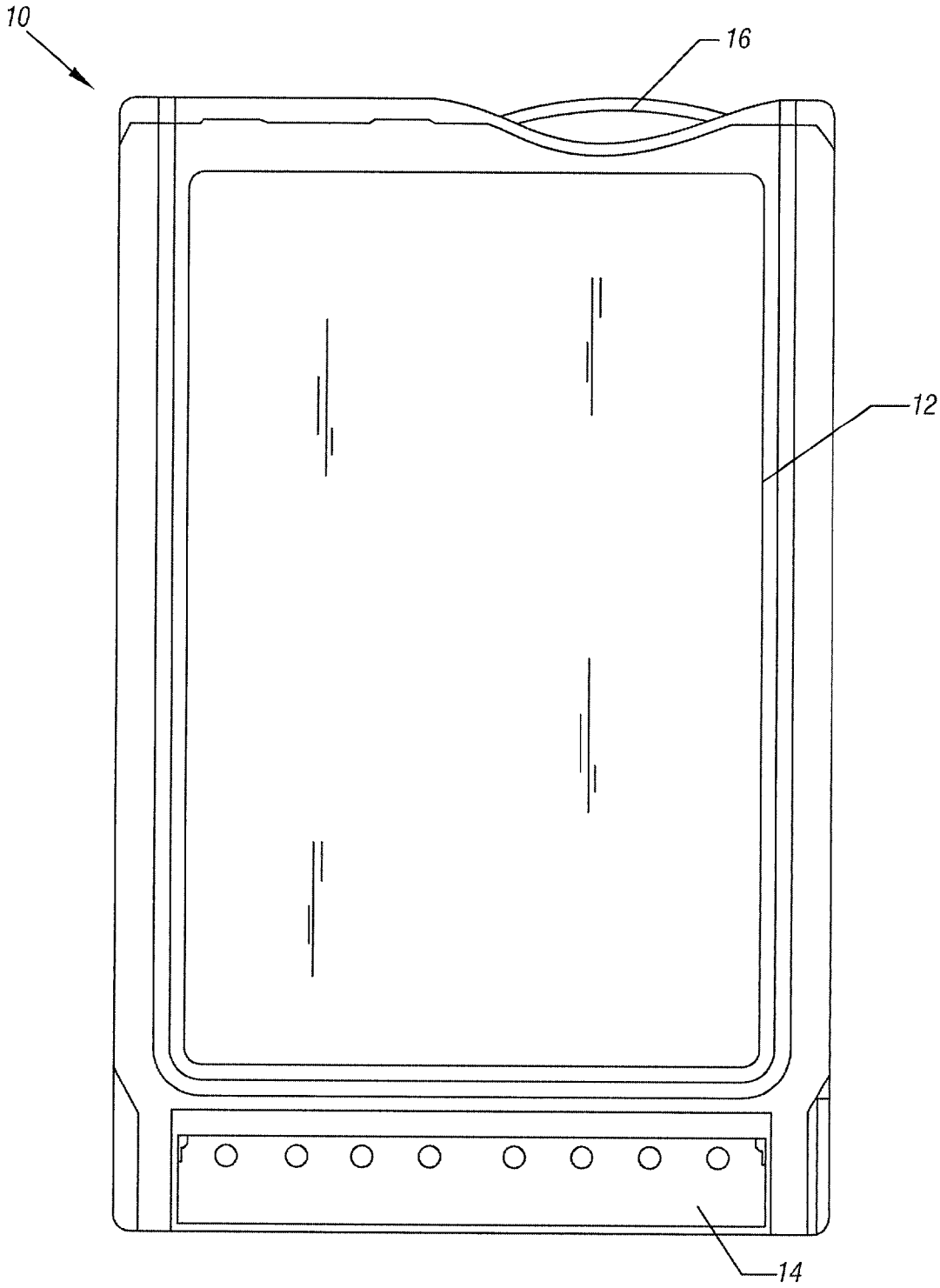
FIG. 1 is an enlarged front elevational view of one embodiment of the present invention with the antenna retracted.

Referring to FIG. 1, a personal computer (PC) card 10 may include a generally flat housing 12 having electrical contacts 14 on one edge and an extendable antenna 16 on the other edge. The housing 12 may house electronic components to implement wireless communications. For example, a personal computer may receive the card 10 and may thereby be able to wirelessly communicate with other personal computers.

Figure 2:
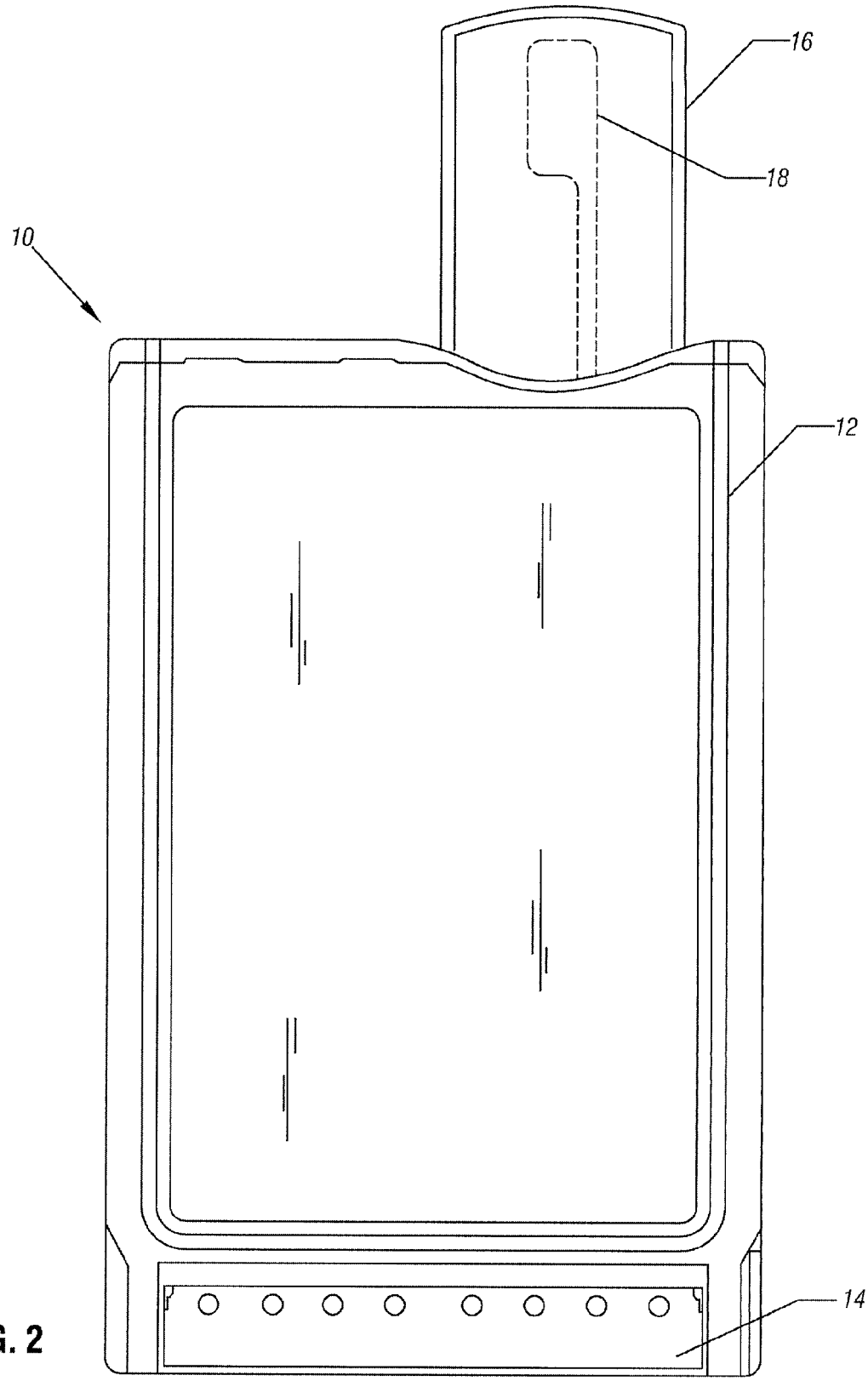
FIG. 2 is a front elevational view of the embodiment shown in FIG. 1 with the antenna extended.

Referring to FIG. 2, by pushing on the retracted antenna 16, the antenna 16 can be caused to spring outwardly. The antenna 16 includes a antenna element 18 that may be a flat metallic element.

Figure 3:
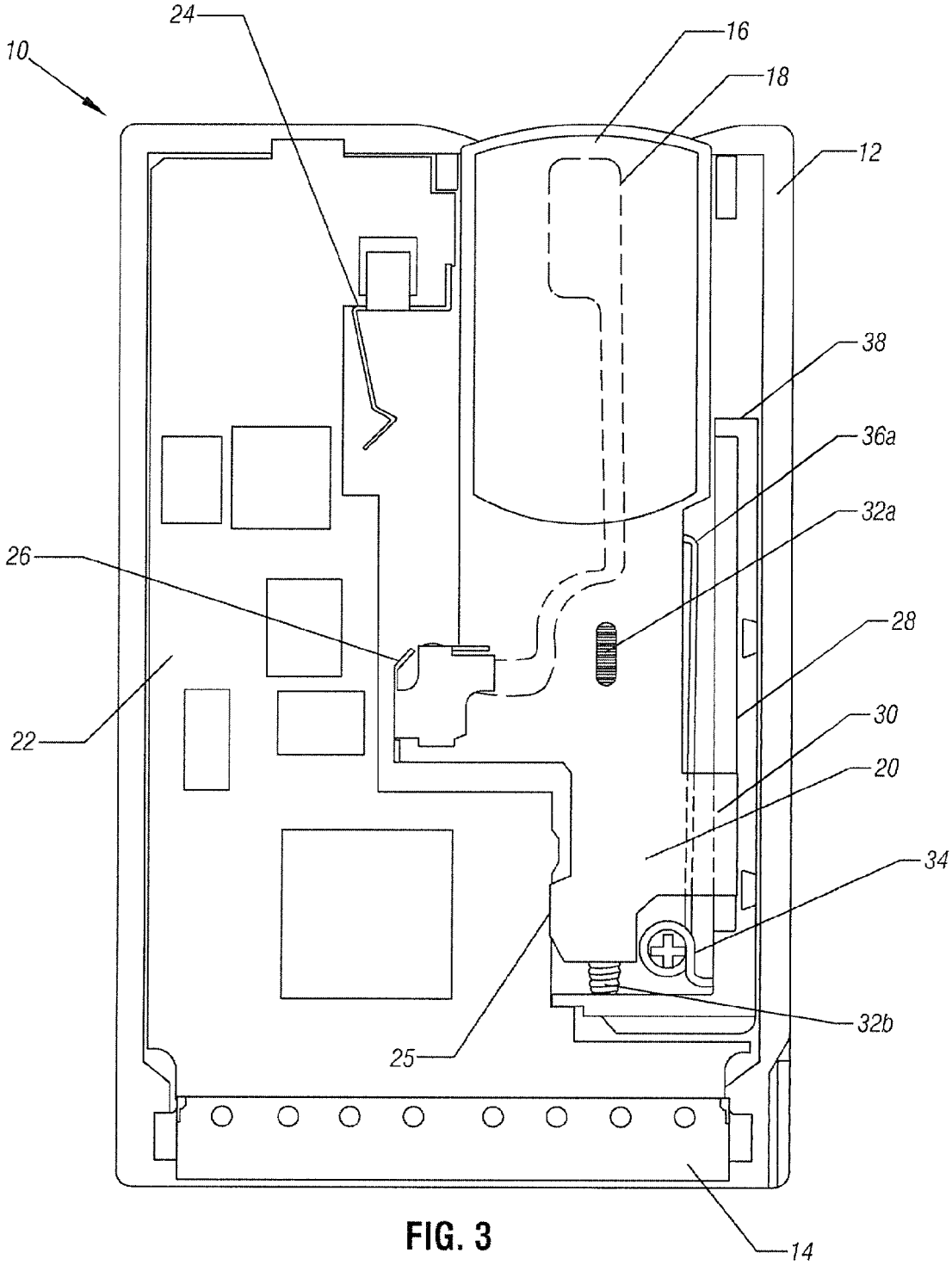
FIG. 3 is an enlarged, horizontal cross-sectional view of the embodiment shown in FIG. 1.

Referring to FIG. 3, the card 10 may include a printed circuit board 22 with a plurality of components for implementing wireless communications. Those components may be electrically connectable to the antenna element 18 through a spring contact 24. The spring contact 24 on the printed circuit board 22 makes an electrical connection with the contact 26 when the antenna 16 is extended out of the housing 12.

The antenna 16 may include a traveler 20 on one end. The traveler 20 includes the contact 26 that makes an electrical connection to the spring contact 24 when the antenna 16 is extended.

The outward extension of the antenna 16 is under control of a compressed coil spring 32 which includes an upper portion 32*a* and a lower portion 32*b*. The antenna 16 may be held in a retracted position against the force of the spring 32 by an L-shaped resilient catch 36. The catch 36 includes a transverse end 36*a* and a helical coil 34.

As referred to herein, "proximal" refers to items that are closer to the contact 14 and "distal" refers to items closer to the position where the antenna 16 extends outwardly from the housing 12. Thus, the helical coil 34 is proximal relative to the distal transverse end 36*a* of the catch 36.

Figure 4:
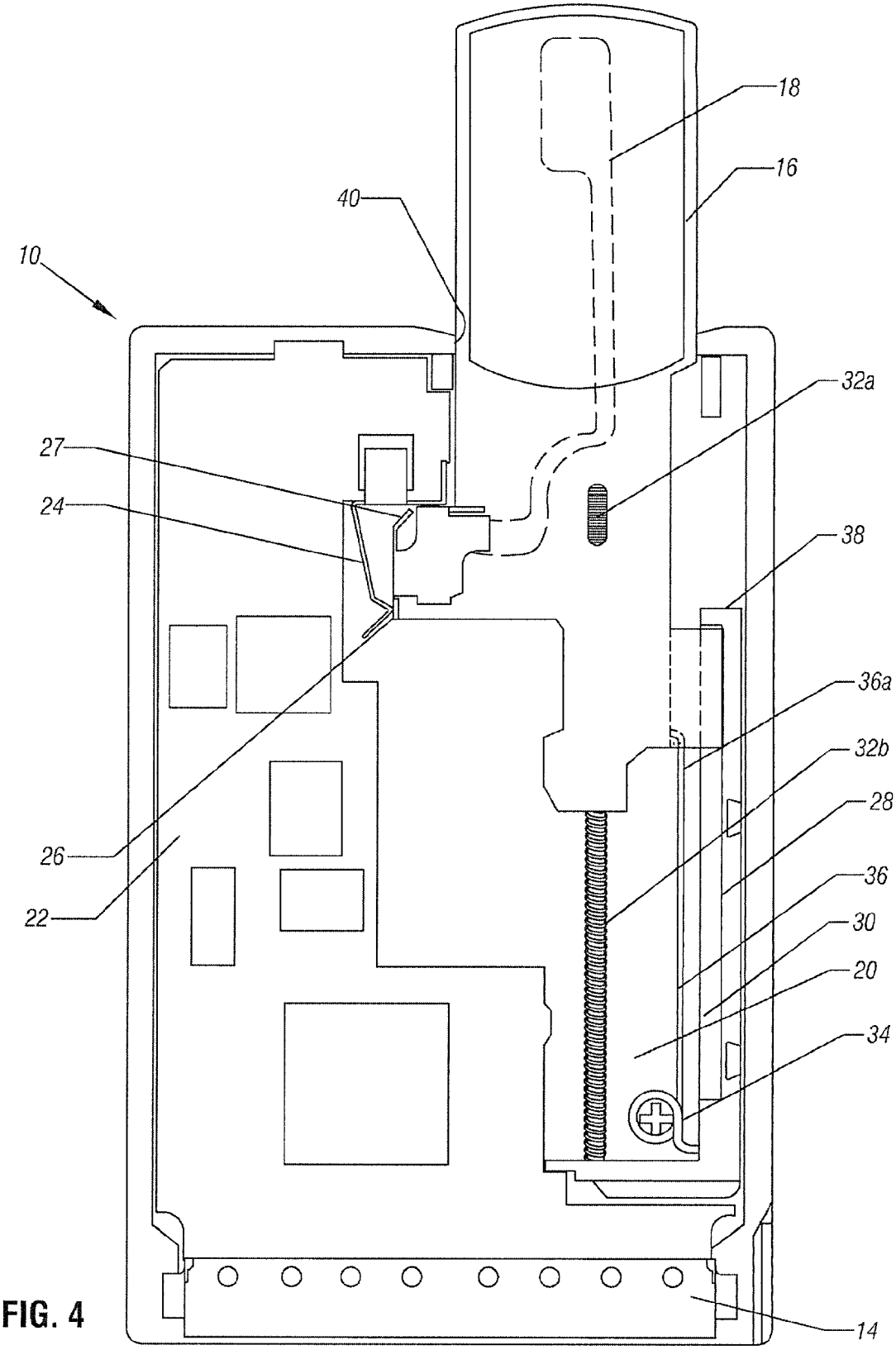
FIG. 4 is a horizontal cross-sectional view of the embodiment shown in FIG. 2.

The traveler 20 rides on a track 28 so as to extend from its proximal position shown in FIG. 3 to its distal position shown in FIG. 4. The extent of distal extension of the antenna 16 may be controlled by a stop 38 that limits the distal extension of the U-shaped housing 30 on the track 28.

Referring to FIG. 4, the spring 32 may be wound around a telescoping rod so as to push the traveler 20 distally, causing the antenna 16 to extend out of the housing 12. In this position, the end 36*a* of the catch 36 is released from the side of the traveler 20. The traveler 20 transitions distally over the track 28 to extend the antenna 16.

The side-to-side extension of the catch 36 is controlled by the tension supplied by the helical coil 34 and by the internal resiliency of the catch 36.

As noted in FIG. 4, the contact 24 makes contact with the contact 26 on the traveler 20, allowing radio frequency signals to be transmitted or received from the integrated circuits included on the printed circuit board 22.

The extent of outward extension of the antenna 16 from the housing 12 may be increased by offsetting the coil spring 32 from the track 28. That is, by allowing the coil spring 32 to actually extend beyond the track 28 at the proximal end, greater antenna 16 outward extension can be achieved.

The printed circuit board 22 includes a protrusion 23 that engages a protrusion 25 on the traveler 20. This provides a snap action when the antenna 16 is retracted to its proximal position, shown on FIG. 3, from its distal position shown in FIG. 4.

Figure 5:
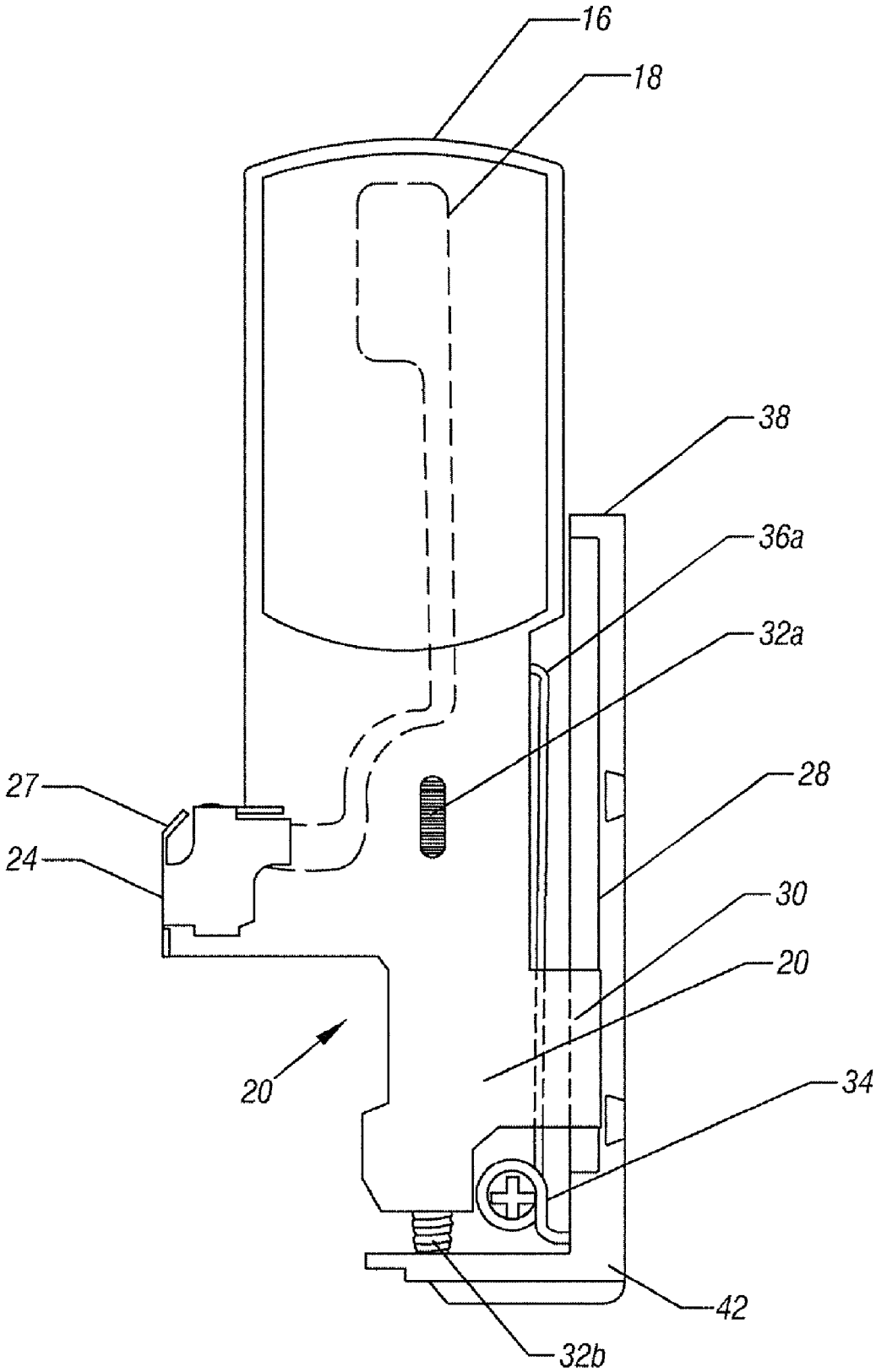
FIG. 5 is a front elevational view of a traveler in accordance with one embodiment to the present invention in its retracted position.

Referring to FIG. 5, the traveler 20 rides on an L-shaped element 42 secured to the housing 12. One end of the helical coil 34 and one end of the spring 32 may be secured in the L-shaped member 42. Also secured to the L-shaped element 42 is the track 28. In one embodiment, the U-shaped housing 30 may include a cantilevered, L-shaped resilient arm 30 on each side of the track 28 to releasably, slideably engage and be guided by the track 28.

Figure 6:
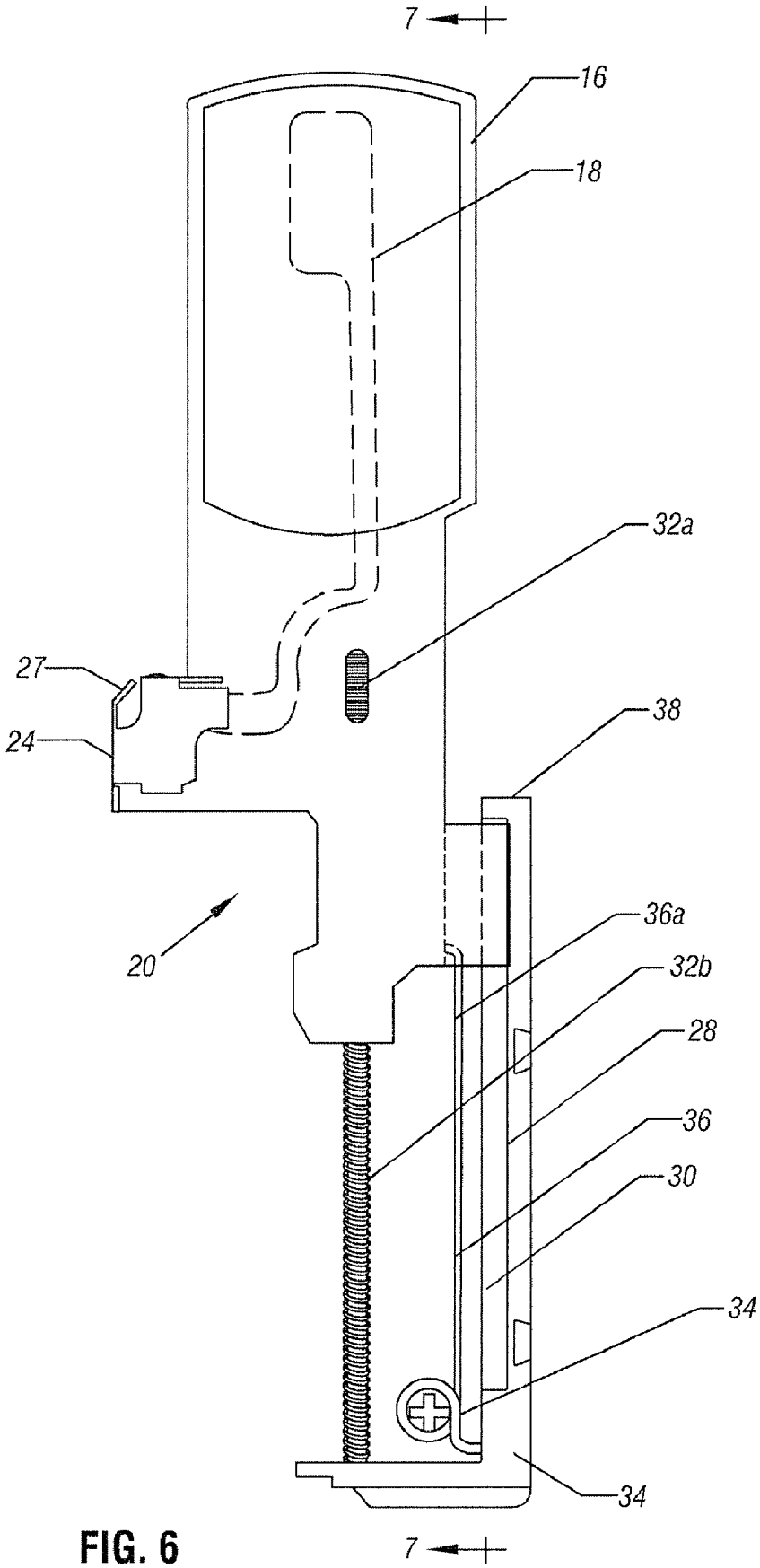
FIG. 6 is a front elevational view of the traveler of FIG. 5 in its extended position.
Figure 9:
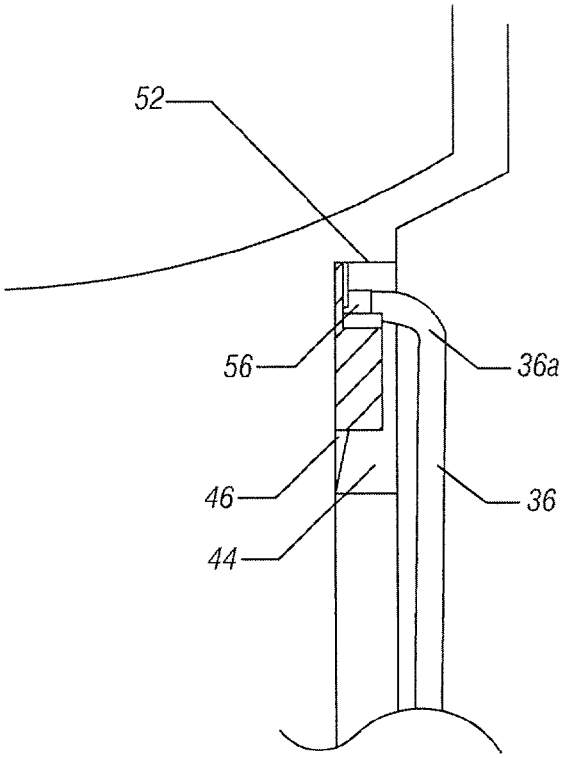
FIG. 9 is a cross-section view corresponding to FIG. 8 when the keeper is in its locked position.

When the traveler 20 begins to extend distally from the position shown in FIG. 5, the end 36*a* of the catch 36 disengages from the traveler 20 to allow distal movement. Thus, the end 36*a* is flexed laterally, allowing the traveler 20 to extend distally, as shown in FIG. 6.

Figure 7:
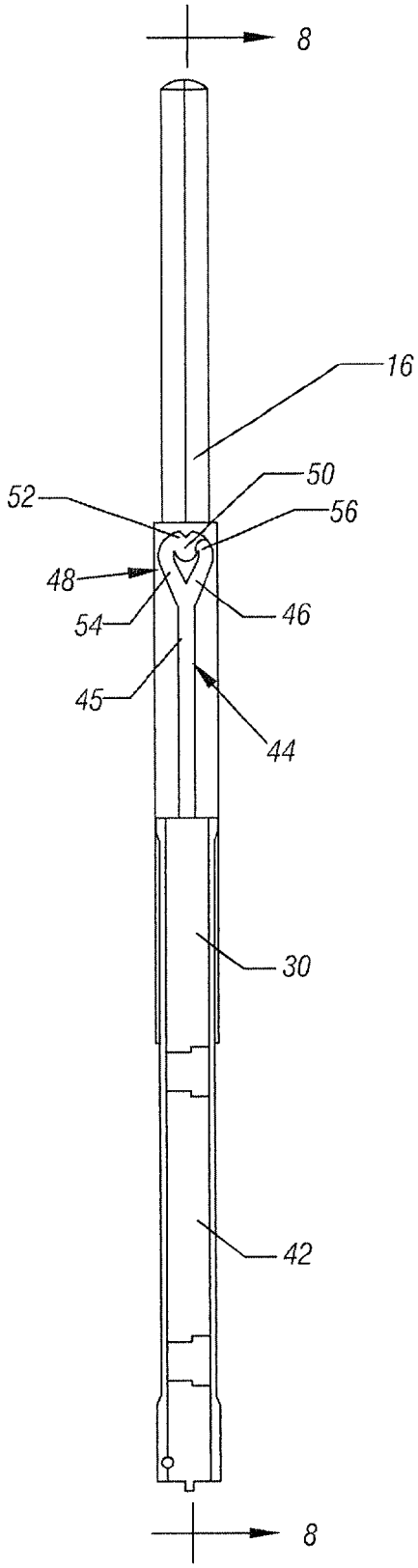
FIG. 7 is a cross-sectional view taken generally along the line 7—7 in FIG. 6.

Turning next to FIG. 7, the end 36*a* travels in a groove 44 in the edge of the traveler 20. The groove 44 includes a generally straight portion 45 and, at the distal end, a generally heart-shaped portion 46. The heart-shaped portion 46 right side includes an inclined track portion 56 that causes the end 36*a* to extend away from the groove 44 and then to fall and be locked in to releasably locked position 50. In this position, the traveler 20 is held against distal extension outwardly of the housing 12.

In order to free the antenna 16 for extension, the antenna 16 must be pushed proximally causing the protrusion 52 to wedge the end 36*a* to the left side of the heart-shaped portion 46 of the groove 44, as shown in FIG. 7, freeing the end 36*a* from its entrapment within the locked position 50. This release allows the spring 32 to take over, causing the end 36*a* to ride back down the track portion 54 and down the straight portion 45 while the antenna 16 extends distally.

Figure 8:
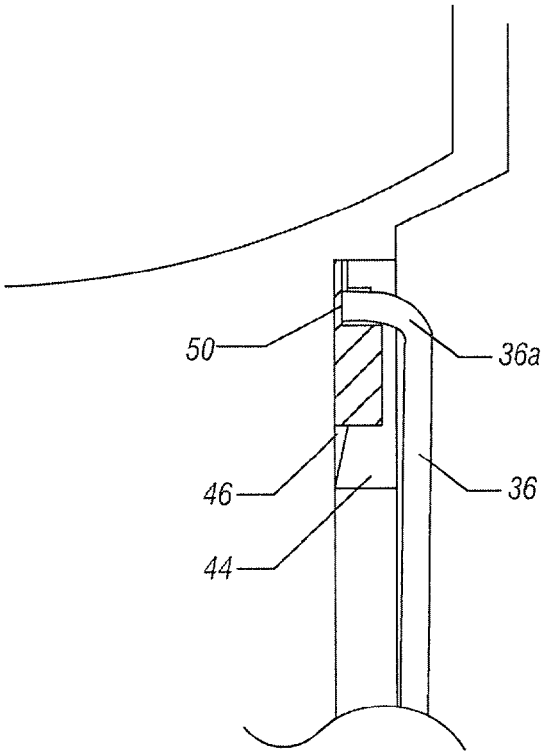
FIG. 8 is a partial cross-sectional view taken generally along the line 8—8 in FIG. 7.

Thus, referring to FIG. 8, when the end 36*a* is trapped in the position 50, the antenna 16 is releasably locked against distal movement. When the antenna 16 is pressed down, the protrusion 52 wedges the end 36*a* to the left allowing it to be released through the left lateral track portion 54.

In some embodiments the extent of movement of the traveler 20 may be significantly greater than with prior designs. For example, prior designs may provide for limited travel of approximately 17 millimeters. With embodiments of the present invention, a longer stroke of approximately 27 millimeters may be generated resulting in 5 millimeters of extra antenna 16 extension in some embodiments.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A personal computer card comprising:

an extensible antenna;

a coil spring to extend a first distance to push the antenna from a retracted to an extended position;

a track laterally displaced with respect to the coil spring to guide the antenna as it is pushed to its extended position, said track having a length, said first distance being greater than the length of said track; and a catch that retains the antenna in the retracted position in said track, said catch being spring biased.

2. The card of claim 1 wherein said track extends parallel to but is laterally displaced from the coil spring.

3. The card of claim 1 including a traveler that mounts said antenna and makes an electrical connection with a printed circuit board when said antenna is in its extended position.

4. A method comprising:

providing an extensible antenna in a personal computer card;

providing a coil spring to push the antenna a first distance from a retracted to an extended position;

displacing the track laterally with respect to said coil spring to guide the antenna as it is pushed to its extended position, said first distance being greater than the length of the track; and providing a resiliently biased follower to ride in said track and to control the position of said antenna as it moves between retracted and extended positions.

5. The method of claim 4 including extending said track parallel to but laterally displaced from the coil spring.

6. The method of claim 4 including enabling the antenna to move approximately 27 millimeters.

7. The method of claim 4 including positioning a catch to releasably retain said antenna in the retracted position and enabling the catch to be released when the antenna is pushed beyond its retracted position.

8. The method of claim 7 including enabling the antenna to move more than 17 millimeters.

* * * * *